United States Patent [19]

Seragnoli et al.

[11] Patent Number: 4,517,871

[45] Date of Patent: May 21, 1985

[54] CUTTING DEVICE FOR CONTINUOUS RODS OF CIGARETTE

[75] Inventors: Enzo Seragnoli; Riccardo Mattei, both of Bologna, Italy

[73] Assignee: G.D Societa' per Azioni, Bologna, Italy

[21] Appl. No.: 461,605

[22] Filed: Jan. 27, 1983

[30] Foreign Application Priority Data

Feb. 2, 1982 [IT] Italy ..... 47702 A/82

[51] Int. Cl.[3] ..... A24C 5/28

[52] U.S. Cl. ..... 83/677; 83/337; 83/661; 83/926 C; 83/926 H

[58] Field of Search ..... 83/310, 337, 341, 355, 83/356, 677, 661, 926 C, 926 H, 591; 30/276

[56] References Cited

U.S. PATENT DOCUMENTS

| | | | |
|---|---|---|---|
| 1,992,735 | 2/1935 | Bronander | 83/677 X |
| 3,739,674 | 6/1973 | Zychal | 83/661 X |

*Primary Examiner*—James M. Meister

*Attorney, Agent, or Firm*—Marshall, O'Toole, Gerstein, Murray & Bicknell

[57] ABSTRACT

A cutting device for continuous rods of cigarette, in which a substantially cylindrical cutting head is rotatably mounted about its axis on a support and is drivingly connected by a central coupling to a drive shaft extending through the support, the cutting head being provided with a flexible cutting blade incrementally removable from a magazine at least in part constituted by a guide for the blade extending through the head in a substantially diametrical direction and around the coupling.

7 Claims, 3 Drawing Figures

CUTTING DEVICE FOR CONTINUOUS RODS OF CIGARETTE

BACKGROUND OF THE INVENTION

The present invention relates to a cutting device for continuous rods of cigarette.

In cigarette packaging machines it is known to utilise output units constituted by cutting devices which can separate a continuous rod of cigarette product into individual pieces. In general, the said known cutting devices include a cutting head supported in an adjustable manner from a support body and rotatable with respect to this latter about its axis. At least one radial blade of elongate and substantially rectangular form is normally mounted on the said rotatable head, the cutting edge at the end of which blade projects radially out from the head. The blade is coupled to an advancement device the function of which is to cause progressive extension of the blade as it is gradually worn away in use.

Until now the blades mounted on the said cutting heads have been shorter than the radius of the heads themselves and, because of their rapid consumption, must be replaced one or more times during each working session consequently causing stoppage of the associated packaging machine for relatively long periods. Given the relatively high productivity of packaging machines such frequent stops significantly affect the general costs of cigarette manufacture.

SUMMARY OF THE INVENTION

The object of the present invention is to provide a cutting device for continuous rods of cigarette, in which each blade will be able to last for a period of time corresponding to at least one working session, in such a way that it can be replaced during the normal stoppages in work and does not, therefore, involve any undue stoppage in production.

The said object is achieved by the present invention in that it relates to a cutting device for continuous rods of cigarette comprising a substantially cylindrical cutting head mounted rotatably about its axis on a support body, a drive shaft extending through the said support body and angularly connected to the said head by means of a central coupling, at least one flexible blade mounted in a substantially radial manner on the said head, and advancement means operable to cooperate with the said blade to cause its progressive extension from the said head, characterised by the fact that the said head further includes within it a magazine for the said blade; the said magazine being constituted at least in part by a guide extending through the said head in a substantially diametral direction and around the said central coupling.

BRIEF DESCRIPTION OF THE DRAWINGS

Further characteristics and advantages of the present invention will become apparent from the following description with reference to the attached drawings, which illustrate various non-limitative embodiments thereof, in which.

DETAILED DESCRIPTION OF THE INVENTION

Figure 1:
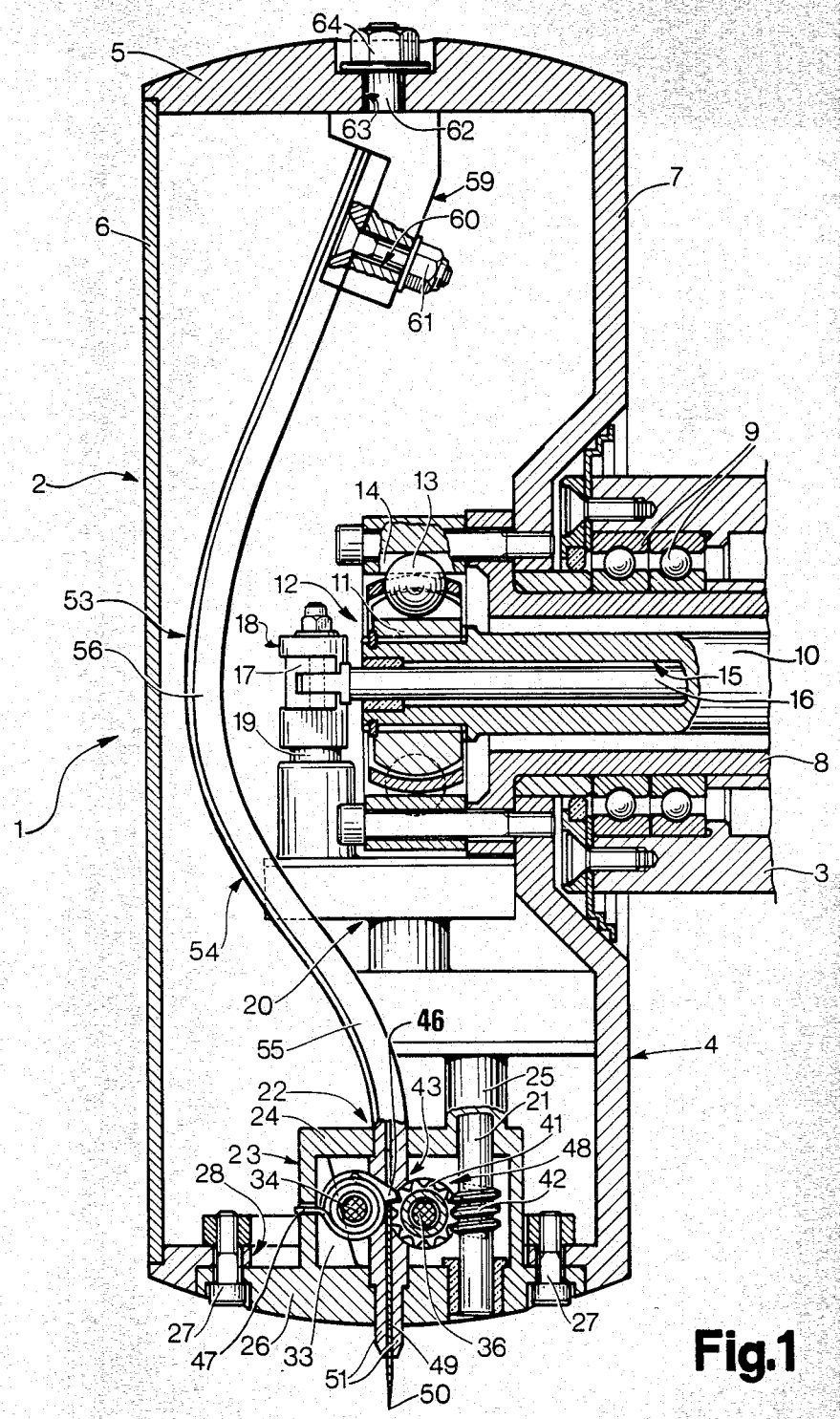
FIG. 1 schematically illustrates in axial section a cutting device formed according to the principles of the present invention.

FIG. 1 illustrates a cutting device generally indicated 1 and including a cutting head 2 of substantially cylindrical form coupled rotatably to a tubular support 3 coaxial with it. The head 2 includes an outer casing 4 having a substantially cylindrical side wall 5 closed at its ends by two flat walls 6 and 7 the second of which is disposed facing the tubular support 3 and is provided with a tubular projection 8 coaxial with the wall 5 and extending into the tubular support 3 to which it is connected rotatably by radial bearings 9.

Along the tubular support 3 extends a drive shaft 10 connected to a driving device not illustrated and including an end section extending through the tubular projection 8 and into the casing 4 and carrying keyed thereto the inner splined ring 11 of a Rzeppa constant velocity joint 12 angularly coupled by means of balls 13, to an outer splined ring 14 of the joint 12 connected rigidly to the inner surface of the wall 7 in a position coaxial to the wall 5. The shaft 10 has an axial through hole 15 through which is slidably mounted a shaft 16 one end of which is connected to a drive device not illustrated which can impart to the shaft 16 a rectilinear forward and back movement along the hole 15. The other end of the shaft 16 is connected to a fork 17 rigidly coupled to an input member of a free wheel device 18, an output shaft 19 of which is connected to a reduction gear 20 housed within the casing 4.

The reduction gear 20 has an output shaft 21 extending in a substantially radial direction with respect to the casing 4 through a support body generally indicated 22 and including a casing 23, a wall 24 of which within the casing 4 has a tubular projection 25 traversed by the shaft 21, and an outer wall 26 of which has the form of a substantially flat and circular plate rigidly connected to the wall 5 by means of a plurality of screws 27 in such a way as to close a radial hole 28 formed through the wall 5.

Figure 2:
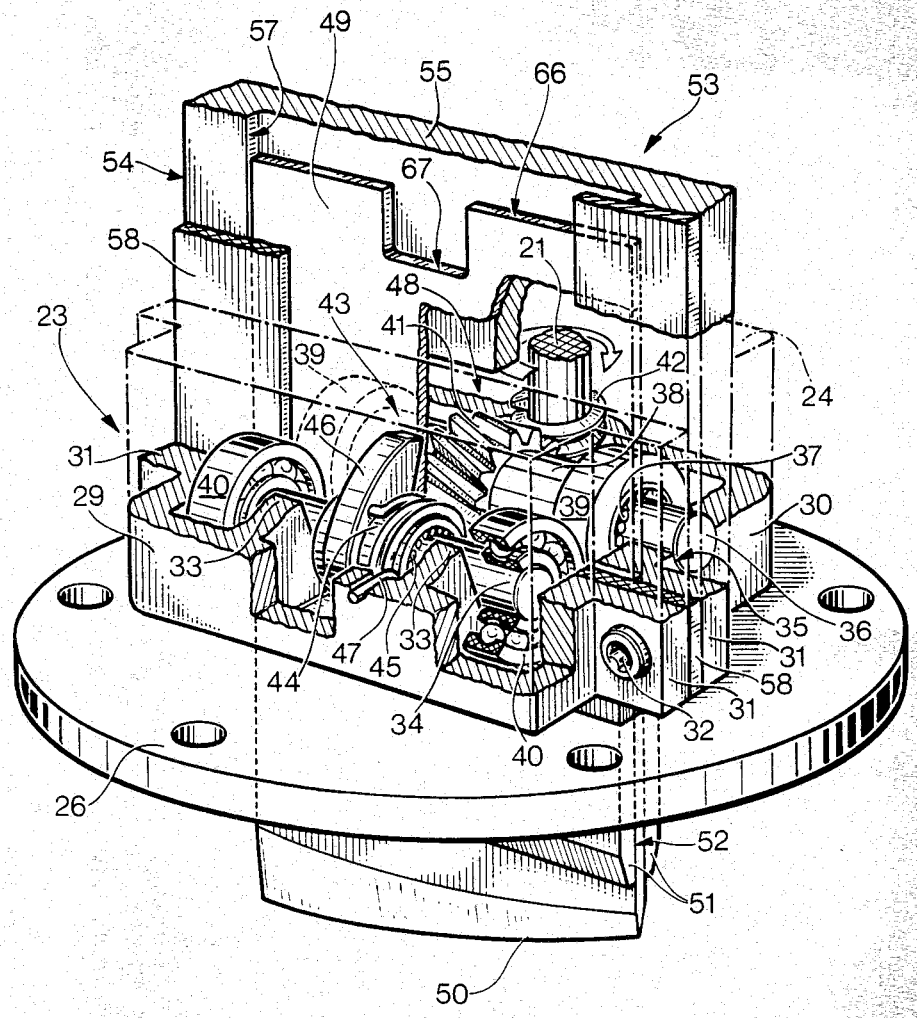
FIG. 2 is an enlarged perspective view, with parts in section and parts removed for clarity of a detail of FIG. 1.

As illustrated in FIG. 2, the casing 23 includes two half-shells 29 and 30 provided with flanges 31 facing one another and connected by means of a plurality of screws 32. The half-shell 29 has inner wedge-shape projections 33 serving as inclined supports for a first shaft 34 disposed within the casing 23 and extending in a direction substantially perpendicular to the axis of the shaft 10.

Through the opposite side walls of the half-shell 30 are formed two coaxial holes 35 rotatably engaged by the opposite ends of a second shaft 36 parallel to and facing the shaft 34, which extends in a position adjacent an intermediate section of the shaft 21 and in a direction perpendicular to the axis thereof.

Above an intermediate section of the shaft 36 there is rotatably mounted, by means of the interposition of needles 37, a tubular sleeve 38 on the outer surface of which are carried two end rings 39 disposed tangentially in contact with the outer rings of respective ball-bearings 40 the inner rings of which are keyed on the shaft 34, and an intermediate helical worm wheel 41 which meshes with a worm gear 42 formed on the said intermediate section of the shaft 21.

On a central portion of the shaft 34 there is mounted a locking mechanism 43 operable to cooperate with the worm wheel 41 to lock the rotation of the sleeve 38, and therefore of the shaft 21, and including a tubular sleeve 44 mounted rotatably on the shaft 34 with the interposition of needles 45 and externally provided with a pawl 46 which can engage the teeth 41 of the worm wheel under the thrust of helical spring 47 mounted on the sleeve 44 and attached at one end to the pawl 46 and at the other end to the half-shell 29. The shafts 34 and 36, the rings 39, the bearings 40 and the locking device 43 constitute an actuator device 48 driven by the shaft 21 via the coupling comprising the toothed wheel or worm wheel 41 and worm screw 42, incrementally to advance a blade 49, constituted by an elongate strip of metal of substantially rectangular form, out from the head 2. A cutting edge 50 at the end of the blade 49 projects out from the head 2 and extends beyond the end of two counterposed guides 51 connected to the outer surface of the wall 26 and together defining a slot 52. From this latter the blade 49 penetrates into the casing 23 and extends from the rings 39 and the bearings 40 in such a way as to cooperate with the free end of the pawl 46 and maintain this raised with respect to the teeth of the worm wheel 41. To the inner wall 24 of the casing 23 there is rigidly connected the lower end of a magazine generally indicated 53 and comprising a guide 54 communicating with the casing 23 through the wall 24 and operable to receive an inner portion of the blade 49.

As illustrated in FIG. 2, the guide 54 includes a wall 55 extending from the flange 31 of the half-shell 30 towards the interior of the head 2 and in a substantially diametral direction with respect thereto, and including an intermediate curved portion 56 passing around the coupling constituted by the constant velocity joint 12. The wall 55 has, on its surface, a seat 54 of substantially rectangular section which can be engaged slidably by the blade 49. This latter is retained in the seat 57 by two elongate containment strips 58 connected to the wall 55 on opposite sides of the seat 57 and extending partially above this latter. In the embodiment illustrated in FIG. 1 the magazine 53 is constituted by the guide 54 which traverses the whole of the head 2 in a substantially diametral direction and is connected at its end opposite that connected to the casing 23 to an anchoring bracket 59 having on one side a hole 60 engaged by a fixing screw 61 of the guide 54, and on the other a threaded pin 62 extending through a radial hole 63 formed through the wall 5 in a position coaxial with the hole 28. The bracket 59 is secured to the wall 5 by means of a nut 64 screwed onto the threaded pin 62.

Figure 3:
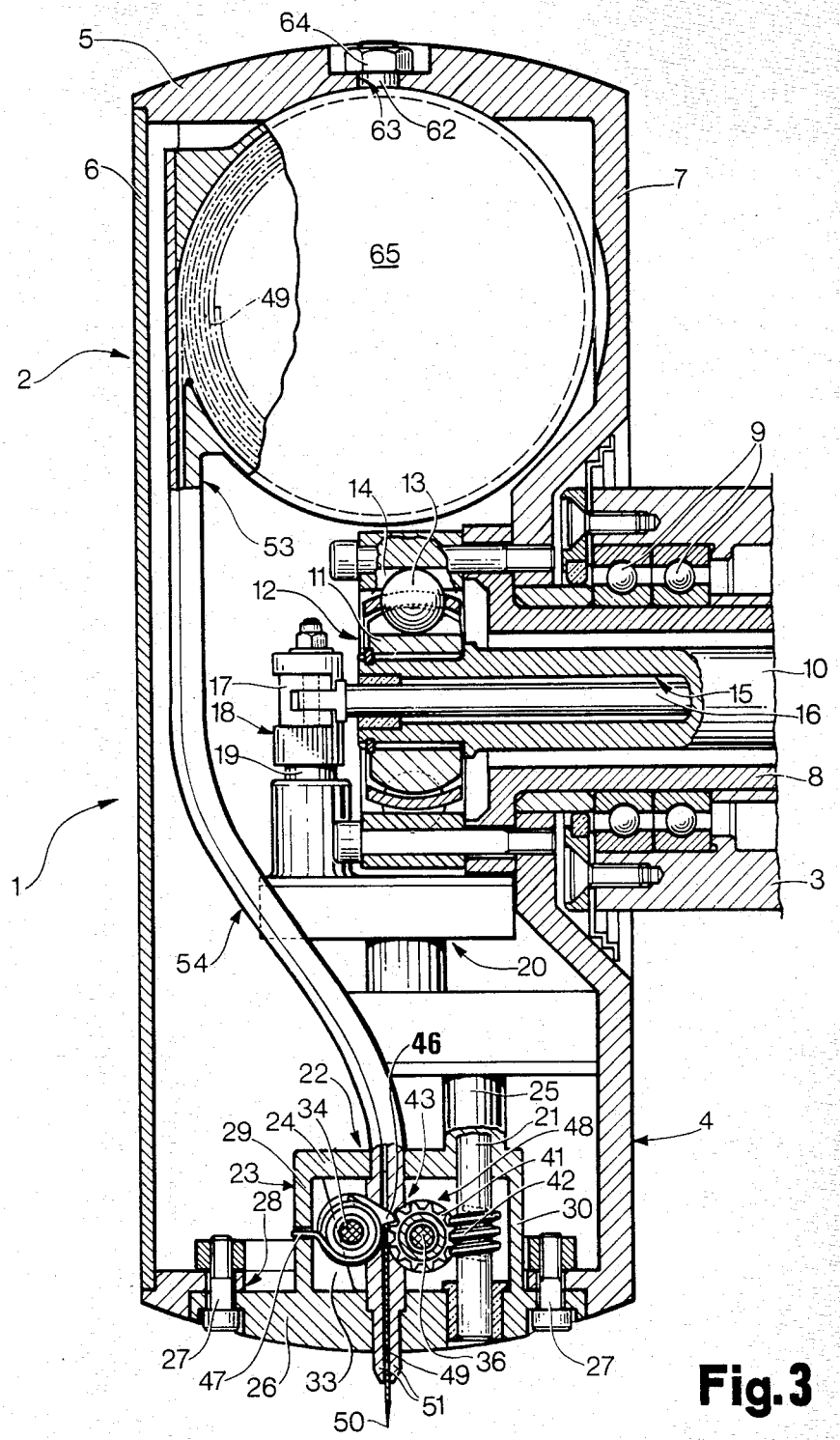
FIG. 3 is similar to FIG. 1 and relates to a variant of the device of FIG. 1.

In the embodiment illustrated in FIG. 3, the magazine 53 includes, as well as the guide 54, a container 65 fixed to the interior of the head 2 between the walls 6 and 7, which communicates with the guide 54 in such a way as to receive a relatively long section of blade 49 wound into a spiral.

As illustrated in FIG. 2, an end edge 66 of the blade 49 opposite the cutting edge 50 has a central notch 67 which permits the rotation of the pawl 49 and the locking thereby of the teeth 41 of the worm wheel before the edge 66 has passed the rings 39 and the counterposed bearings 40.

In use the to-and-fro movement of the rod 16 within the shaft 10 is transformed by the free wheel device into an incremental rotary movement of the associated output shaft 19 and, therefore, of the shaft 21. Consequently, to the sleeve 38 there are imparted angular displacements uniformly distributed in time with a given frequency, which are transmitted by friction to the outer rings of the bearings 40 and cause incremental advancement of the blade 49. This latter is clamped between the rings 39 and the bearings 40 because of the presence of the wedge-shape projections 33 which allow the shaft 34 to slip sideways to approach the shaft 36. The presence of the magazine 53 permits extremely long blades 49 to be mounted, which are capable of lasting even for several work sessions.

When the blade 49 becomes exhausted, the notch 67 passing in front of the pawl 46 permits this latter to snap towards the teeth 41 of the worm wheel and angularly lock this and the shaft 21 thereby stopping the outward advancement of the blade 49 before the edge 66 has passed between the rings 39 and the bearings 40, so that the blade 49 cannot become free to be projected out from the head 2 by centrifugal force. Naturally, the principle of the invention remaining the same, numerous modifications would be possible to the device described purely by way of non-limitative example without by this departing from the scope of the present invention.

The head 2 could for example be provided with several blades 49 projecting from the wall 5 in correspondence with respective angularly equidistant zones. In this case the blades 49 would be housed within respective magazines similar to the magazines 53 or 65 already described, which would have to be formed and disposed within the head 2 in such a way as not to interfere with one another upon rotation.

We claim:

1. A device for cutting continuous rods of cigarette comprising a substantially cylindrical cutting head (2) mounted rotatably about its axis on a support body (3), a drive shaft (10) extending through the support body (3) and connected to rotate the said head (2) by means of a central coupling (12), at least one flexible blade (49) mounted in a substantially radial manner on the said head (2), and advancement means (48) operable to cooperate with the said blade (49) to cause progressive extension thereof from the said head (2), characterised by the fact that the said head (2) further includes within it a magazine (53) for the said blade (39); the said magazine (53) being constituted at least in part by a guide (54) extending across the said head (2) in a substantially diametral direction and around the said central coupling (12).

2. A device according to claim 1, characterised by the fact that the said guide (54) extends from one side to the other of the said head (2) and includes an intermediate curved portion (56) extending around the said central coupling (12).

3. A device according to claim 1, characterised by the fact that the said guide (54) is connected to a container (65) housed within the said head (2) and operable to receive a section of the said blade wound in a spiral.

4. A device according to claim 1, characterised by the fact that the said guide (54) includes a wall (55) having on its surface a seat (57) for the said blade (49); this latter being prevented from leaving the said seat (57) by two elongate containment strips (58) connected to the said wall (55) on opposite sides of the said seat (57) and extending partially over this latter.

5. A device according to claim 1, characterised by the fact that the said advancement means (48) include a shaft (21) incrementally rotatable about its axis, and roller and counter-roller means (39–40) disposed on opposite sides of the said blade (49) and tangentially thereto; the said roller means being coupled to the said rotary shaft (21) by means of a coupling (41–42) of the worm wheel and worm gear type.

6. A device according to claim 5, characterised by the fact that the said counter-roller means include a shaft (34) mounted in an angularly fixed position and transversely movable with respect to the said blade (49) and carrying keyed thereto two bearings (40) tangential to the blade (49); this latter having, along an end edge (66) opposite to a cutting edge (50) at an end projecting from the head (2), a notch (67) allowing the passage of locking means (43) for preventing the advancement of the blade (49) itself.

7. A device according to claim 6, characterised by the fact that the said locking means (43) include a sleeve (44) freely rotatably mounted on the said transversely movable shaft (34), a pawl (46) extending from the said sleeve (44) and resilient means (47) acting on the said sleeve (44) to turn it in a direction such as to thrust the said pawl (46) towards the helical teeth (41) of the said coupling (41–42).

* * * * *